United States Patent [19]

Withers et al.

[11] 4,096,751

[45] Jun. 27, 1978

[54] HAND-HELD MICROPIPETTOR WITH FLUID TRANSFER VOLUME ADJUSTMENT MECHANISM

[75] Inventors: Stanley J. Withers, Berkeley; Ronald L. Sturm, San Carlos, both of Calif.

[73] Assignee: Oxford Laboratories Inc., Foster City, Calif.

[21] Appl. No.: 806,909

[22] Filed: Jun. 15, 1977

[51] Int. Cl.[2] ..... B01L 3/02

[52] U.S. Cl. ..... 73/425.6; 222/43

[58] Field of Search ..... 73/425.4 P, 425.6; 222/43, 44, 49, 309

[56] References Cited

U.S. PATENT DOCUMENTS

| | | | |
|---|---|---|---|
| 3,327,900 | 6/1967 | Goda | 222/43 |
| 3,810,391 | 5/1974 | Souvaniemi | 73/425.6 |
| 3,827,305 | 8/1974 | Gilson | 73/425.6 |

*Primary Examiner*—S. Clement Swisher

*Attorney, Agent, or Firm*—Limbach, Limbach & Sutton

[57] ABSTRACT

A micropipettor having an adjustable stop threadedly engaged with an internal reciprocal plunger assembly for defining the stroke length of the plunger and thus of a fluid displacing piston that is attached to the plunger assembly. The adjustable stop is manipulated by operable connection with a volume adjustment knob provided on the outside of the micropipettor body. The plunger carries a coarse volume indicating scale and the volume adjustment knob is provided with a fine volume setting scale. Accidental changes in volume adjustments are avoided by two types of automatic locks: a frictional engagement of the internal volume adjustment mechanism unless the plunger is deliberately placed in a certain position by the operator, and a detent lock of the volume adjustment knob unless the operator deliberately depresses it.

5 Claims, 12 Drawing Figures

HAND-HELD MICROPIPETTOR WITH FLUID TRANSFER VOLUME ADJUSTMENT MECHANISM

BACKGROUND OF THE INVENTION

This invention relates generally to the art of accurately pipetting fluids and particularly to a stroke adjustment mechanism for a plunger and piston assembly of a hand-held micropipettor.

Hand-held micropipettors have become very popular in the past few years as chemical laboratory instruments, especially in medical and clinical laboratories. A typical hand-held micropipettor presently used includes a tube like barrel body structure adapted to be held by the hand and having a plunger assembly therein which extends outward of one end of the body and terminates in a liquid operating knob. A piston is attached to the other end of the plunger within a piston chamber. The piston chamber is maintained in fluid communication with an aperture at an opposite end of the barrel handle, the aperture being shaped to frictionally engage a detachable and disposable pipette tip. The plunger and piston assembly is held in a normal rest position by one or more springs within the barrel handle. When used to transfer liquid, the pipettor plunger is depressed, the attached tip placed in a liquid and the plunger released to draw liquid into the tip. The pipettor is then removed to a container for discharge of the liquid. The liquid is discharged from the tip by again depressing the plunger. If a different liquid is to be pipetted, the disposable plastic tip is removed and discarded and a clean new tip attached to the end of the pipettor.

Various forms of such hand-held micropipettors are illustrated in the following U.S. patents and patent application which are assigned to Oxford Laboratories Inc., of Foster City, Calif., the assignee of the present application: U.S. Pat. Nos. Re. 27,637 — Roach (1973); 3,855,867 — Roach (1974); 3,882,729 — Roach (1975); 3,918,308 — Reed (1975); 4,009,611 — Koffer, et al. (1977); and application Ser. No. 682,401, filed May 3, 1976. Adjustable volume jar mounted liquid pipettors are described in the following U.S. patents having the same assignee: U.S. Pat. Nos. 3,452,901 — Roach (1969); 3,574,334 — Roach (1971); and 3,987,934 — Reed, et al. (1976).

It is often desirable in such liquid pipetting devices to provide for the ultimate user of the device to have the capability of adjusting the volume of liquid to be pipetted. For example, two specific operator controllable volume selecting mechanisms are described in aforementioned U.S. Pat. No. 3,855,867 in a hand-held micropipettor. Each of the three jar mounted pipettor patents given above also disclose mechanisms for controlling the volume of liquid dispensed. In addition, the following three United States patents illustrate adjustable volume hand-held micropipettors of others: U.S. Pat. Nos. 3,613,952 — Gilmont, et al. (1971); 3,810,391 — Suovaniemi (1974) [similar to a device sold under the trademark FINPIPETTE]; and 3,827,305 — Gilson, et al. (1974) [similar to a device sold under the trademark GILSON-RAININ].

It is a primary object of the present invention to provide a mechanism for operator adjustment of the volume of liquid dispensed by a pipettor, principally a hand-held micropipettor, continuously over a given volume range with precision, accuracy and repeatability of volumes pipetted.

It is another object of the present invention to provide a hand-held micropipettor volume adjustment mechanism that is convenient, quick and easy for an operator to manipulate by hand without the necessity of any separate volume adjustment locking action.

It is yet another object of the present invention to provide a pipettor volume adjustment mechanism that is not easily changed by inadvertence or accident during the course of normal pipetting operations.

It is a further object of the present invention to provide a pipettor of a variable volume type having volume setting indicators that provide a high degree of accuracy and definiteness in volume readings.

SUMMARY OF THE INVENTION

These and additional objects are accomplished by the present invention which, briefly, includes the use of a volume adjustment knob for adjusting an internal stop along the length of the plunger. The knob is held adjacent an end of a pipettor body wherein the plunger emerges. In a preferred form, this stop is held by the plunger assembly and in threaded engagement therewith so that its rotation causes it to move axially along the length of the plunger. Motion is transmitted from the volume adjustment knob to the adjustable stop on the plunger through a hollow cylindrical sleeve positioned about the plunger assembly at that end of the pipettor body. The adjustable stop and the interior of the cylindrical sleeve are interconnected to permit rotation of the stop by the sleeve but at the same time to permit free axial movement of the plunger assembly and stop relative to the sleeve.

The portion of the plunger extending out of the pipette body has a linear coarse volume setting scale thereon. The position of the adjustable stop as set by rotating the volume adjustment knob determines the rest position of the plunger assembly and thus its scale reading at the end of the pipettor body. Thus, the desired plunger rest position is read directly without any intervening mechanism that could malfunction. The volume adjustment knob also includes a fine volume setting scale in circular form. The coarse volume scale is set so that the plunger rest position changes from one major volume setting mark to another adjacent volume setting mark by one full revolution of the volume adjusting knob, thereby giving coarse and fine volume adjustment. The volume adjustment mechanism and arrangement of volume indicating scales permits a structure wherein the entire volume range can be traversed by few revolutions of the volume adjustment knob, typically less than ten.

The internal cylindrical sleeve has positioned at its lower end a lower body stop in the form of a washer, the washer and cylindrical sleeve being urged upwards against the inside of the body by a stiff secondary spring having much more force than the primary spring that holds the plunger assembly in its rest position. The secondary spring makes the frictional engagement of the cylindrical sleeve in the pipettor body large so it is very difficult for an operator to accidently change the volume setting by hitting the volume adjustment knob during the course of operating the pipettor. But when a volume change is desired, the operator presses the plunger downward against its primary spring and even against the lower body stop washer to compress the secondary stiff spring somewhat in order to relieve the frictional drag from the cylindrical sleeve. For additional assurance against accidental volume setting changes, the volume adjustment knob is spring loaded upward against a detent that prevents its rotation until the knob is depressed. Both of these volume setting control features form an automatic locking mechanism.

The volume adjustment knob is positioned adjacent the plunger at one end of the micropipettor body in a manner to permit depression of both the plunger and volume adjustment knob to unlock the device, and at the same time to rotate the volume adjustment knob all by a single hand operation if desired. A disposable tip ejecting knob is also positioned at that end of the pipette body but on an opposite side of the plunger so that tip ejection can be accomplished by this same one hand operation as well. No separate locking of the volume adjustment, once set, is necessary since such locking occurs automatically as soon as the plunger and volume adjusting knob are released.

Additional objects, advantages and features of the various aspects of the present invention will become apparent from the following description of a preferred embodiment thereof, which should be taken in conjunction with the accompanying drawings.

DESCRIPTION OF A PREFERRED EMBODIMENT

Figure 1:
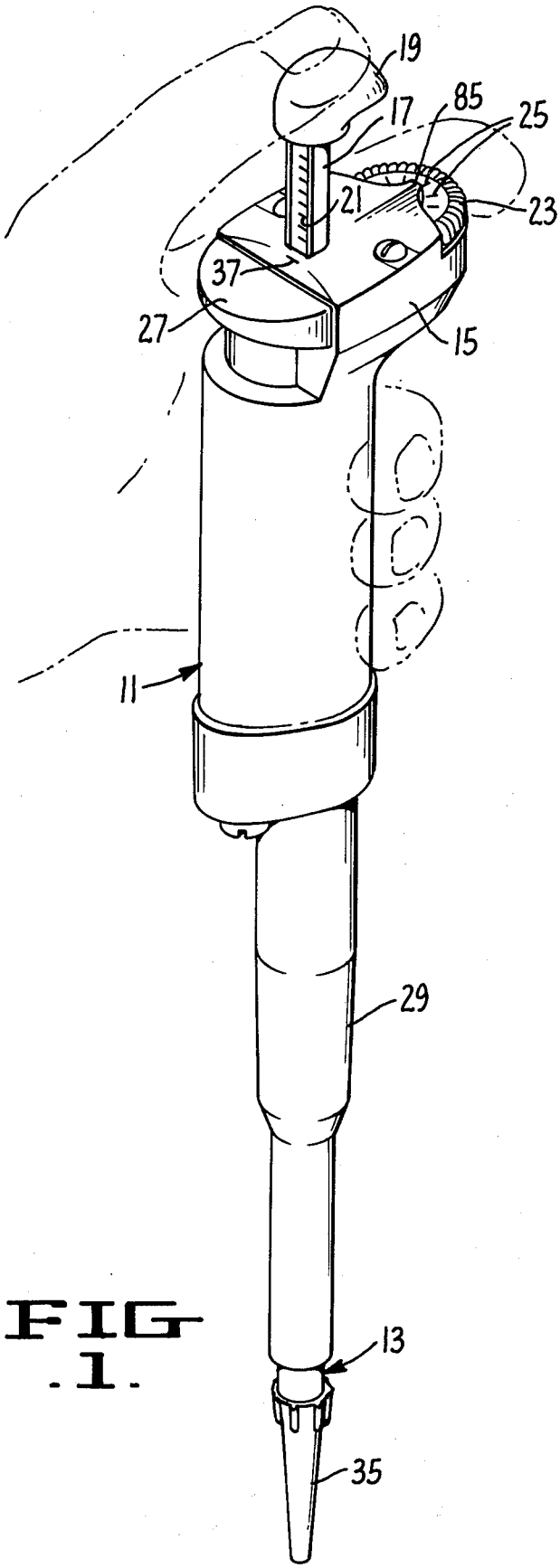
FIG. 1 illustrates a hand-held micropipettor utilizing the various aspects of the present invention as it is held by an operator.
Figure 2:
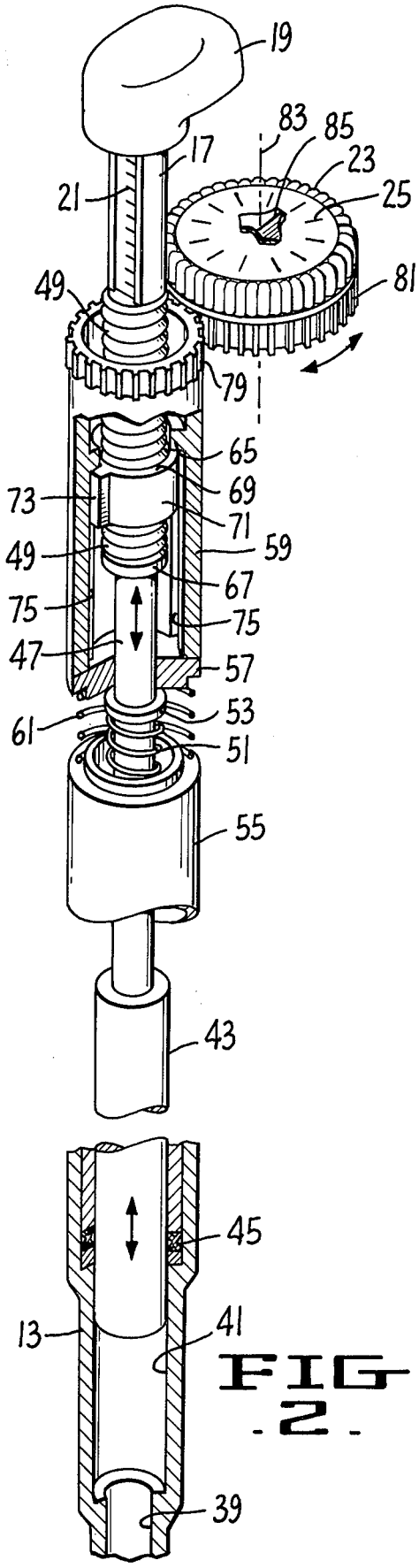
FIG. 2 is a perspective view of the major internal components of the micropipettor of FIG. 1 in which the various aspects of the present invention reside.

Referring principally to FIG. 1, a hand-held micropipettor including the various aspects of the present invention will be generally described. The micropipettor body includes two parts that are threadedly attached to form a single body structure: a handle portion 11 and a lower extremity 13 thereof. Protruding from an upper end piece 15 of the pipettor body is a connecting rod 17 which terminates in a liquid transfer knob 19. A linearly extending scale 21 is permanently carried by the connecting rod 17. The connecting rod 17, as will be explained hereinafter, is an extension of a plunger/piston assembly, a principal operating component of the micropipettor.

Held by the upper end 15 of the micropipettor body is a volume selecting wheel 23 having a serrated or roughened edge for easy positive engagement with an operator's finger and a circular volume scale 25.

Figure 3:
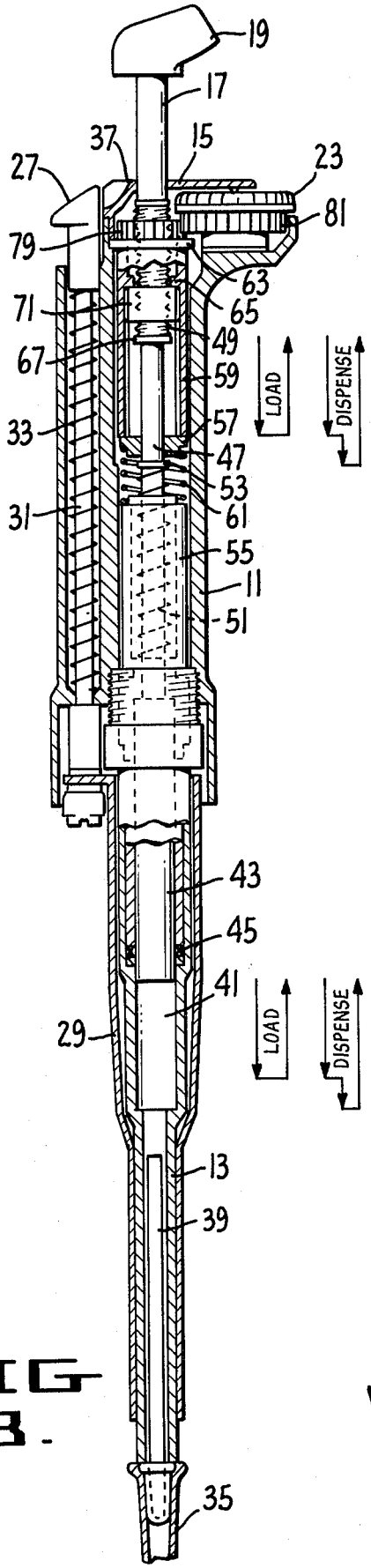
FIG. 3 is a cross-sectional view of the micropipettor of FIG. 1 taken from the side.

A tip ejecting knob 27 is also provided at the top end of the micropipettor body. The knob 27 is firmly connected to a tip ejecting sleeve 29 through a connecting rod 31 (FIG. 3). A spring element 33 (FIG. 3) maintains the tip ejecting knob 27 and the tip ejecting sleeve 29 in a normal upward rest position. The purpose of the tip ejecting mechanism is to dislodge a frictionally engaged plastic disposable tip or vessel 35 from the lower end of the micropipettor body after use without having to handle the used tip 35 by hand. Depression of the knob 27 by an operator's finger or thumb causes the sleeve 29 to move downward and force the tip 35 off the micropipettor end. A new tip can then be placed thereon by hand or with the use of a tip loading rack in accordance with the descriptions of earlier micropipettor system patents specified in the introductory portion thereof.

It will be noted from FIG. 1 that the various elements at the top portion of the micropipettor body are arranged for easy holding by a single hand, either a right or left hand. The upper body 11 is gripped by several fingers of the hand while the thumb operates the liquid transfer knob 19 by pressing it downward toward the upper end of the body 11. The thumb is also used to press, in a subsequent action, the tip ejecting knob 27. The operator's index finger is thus in position to change the volume adjustment by rotating the knob 23, when desired, and at the same time that the liquid transfer knob 19 is depressed in accordance with the safety mechanism to be described hereinafter. For all of these operations, the linear scale 21 remains facing the micropipettor operator which is read by its intersection with a top adjacent surface 37 of the micropipettor body top end portion 15.

Referring principally to FIG. 3, the overall operation of a micropipettor of the type being described will be explained. The lower body portion 13 includes a bore 39 therein that extends from its lower tip in fluid communication with any disposable pipette tip attached thereto upward to a piston chamber 41. A piston 43 reciprocates into and out of the upper end of the piston chamber 41 and is sealed thereto in a fluid tight manner by an appropriate circular seal 45. Connected to an upper end of the piston 43 is a plunger 47 that includes an outwardly threaded portion 49 adjacent its firm connection with the connecting rod 17. The connecting rod 17, threaded plunger portion 49, plunger 47 and piston 43 are all firmly held together in a single unitary structure that is normally urged upward by a primary spring 51. The spring 51 is normally compressed between a stop 53 on the plunger rod 47 and the bottom portion of a cylindrically shaped spacer 55 (See FIG. 4). The spacer 55 is prevented from moving downward by a portion of the body upon which it rests.

In operation, the plunger assembly is depressed against the force of the spring 51 by pushing the liquid transfer knob 19 downward to displace a certain fluid volume within the piston chamber 41. If the tip 35 is submersed into a liquid when the piston is in that state, then a release of the liquid transfer knob 19 will draw liquid into the tip 35 and a repeat of that process will then discharge liquid from the tip 35. The amount of liquid so drawn into the tip 35 is determined by the permitted stroke length of the plunger assembly upon depression and return of the knob 19 and it is this stroke length which is adjusted by the mechanism associated with the volume adjustment knob 23, as will be described hereinafter.

The various elements of the illustrated micropipettor which define the plunger stroke distance will now be outlined. A circular washer 57 serves as a lower body stop and is held in position against the bottom of a cylindrical sleeve 59 by the force of a secondary spring 61. The secondary spring 61 has many times greater force than the primary spring 51. The cylindrical sleeve 59 is held in position with respect to the pipettor body by a flange 63 that is held in a slot of the body formed by joining the main body 11 and the body cap 15. This cooperating flange 63 and the body slot is designed to prevent axial movement of the cylindrical sleeve 59 but at the same time normally permitting rotation of the sleeve with respect to the body. An upper body plunger stroke defining stop is provided by an inwardly turning flange 65 on the cylindrical sleeve 59. Therefore, it is the distance between the flange 65 and the end of the sleeve 59 that provide the fixed body stops which contributed to defining the plunger stroke distance.

A pair of stops also exist on the plunger 47 itself, a lower stop being in the form of a fixed washer 67 which abuts as a limit against the top surface of the previously described body washer 57 as the plunger is depressed downward. An upper plunger stop is formed by an upper surface 69 of a nut 71 that is threaded onto the threaded portion 49 of the plunger assembly. As the nut 71 rotates with respect to the plunger, it moves up and down along the axial length of the plunger. This provides the adjustable plunger stroke length that is desired. The nut surface 69 abuts as a limit against an underside of a flange 65 under the influence of the primary spring 51. Rotation of the nut 71 is accomplished by its connection with the cylindrical sleeve 59 through a pair of keys 73 extending outwardly from the otherwise cylindrical outer surface of the nut 71. The keys 73 ride in opposing slot 75 provided in an axial direction in the inside surface of the sleeve 59. Since the sleeve 59 does not move axially within the body, therefore, this slot and key connection between it and the nut 71 permits rotary motion to be transmitted between the two elements but at the same time also permits the nut 71 to travel in an axial direction as part of the plunger assembly when it is depressed as part of a liquid transfer operation.

The sleeve 59 is provided at its upper end with a gear 79 attached thereto. A mating gear 81 is provided fixed to the volume adjustment knob 23. Therefore, as the knob 23 is rotated about its axis 83, the cylindrical sleeve 59 is rotated. Similarly, the nut 71 is rotated and advanced axially along the plunger in a direction dependent upon the direction of rotation of the knob 23. The axis of the plunger and the axis 83 of rotation of the knob 23 are parallel but displaced.

The overshoot spring 61 serves one purpose that exists in prior micropipettors, namely the ability for the operator to drive the plunger downward a distance further upon discharge of liquid from the disposable tip 35 than the plunger is driven when liquid is drawn thereinto. Referring to the motion arrows that accompany FIG. 3, the typical operation during loading is shown as compared with that during dispensing of liquid. During loading, the plunger is depressed until the plunger stop 67 abuts the lower body stop 57. At this point, the operator feels a significant change in the resistance to further downward force since the overshoot spring 61 is many times stronger than the primary spring 51 which the operator has been encountering up to that point. In this general use of such a device, the operator chooses not to compress the overshoot spring 61. In dispensing liquid, the operator depresses the plunger with the added force necessary to compress the secondary spring 61 with the washer 67 being driven downward and separated from the end of the cylindrical sleeve 59, in a manner shown in FIG. 11.

In the instrument being described, the secondary "overshoot" spring 61 serves an additional function. That function is to urge the cylindrical sleeve 59 against its contacting portions with the body 11 in a manner to create a heavy frictional load that makes it difficult to change the volume. That is, the sleeve 59, through its flange 63, is urged in tight frictional engagement with the upper portion of the slot formed in the body, principally against the cap 15. Accidental adjustment of the volume by inadvertent operator moving of the knob 23 during normal use of the micropipettor is thus avoided.

A second lock against an accidental volume change is provided by two detents 91 and 93 that depend downward from the body end piece 15 and engage cooperatively shaped depressions in the top surface of the volume adjustment knob 23 around its outer circumference. To rotate the knob 23, it is first depressed downward against the force of a spring 95 until the knob is free of the detents 91 and 93. A very large number of knob depressions are provided in order to allow for a large number of specific liquid transfer volume settings. Thus, the volume selections are effectively continuous while at the same time providing positive positions of the volume adjustment knob 23 to eliminate visual errors of misalignment of the indicator 85 with a line of the scale 25.

Figure 11:
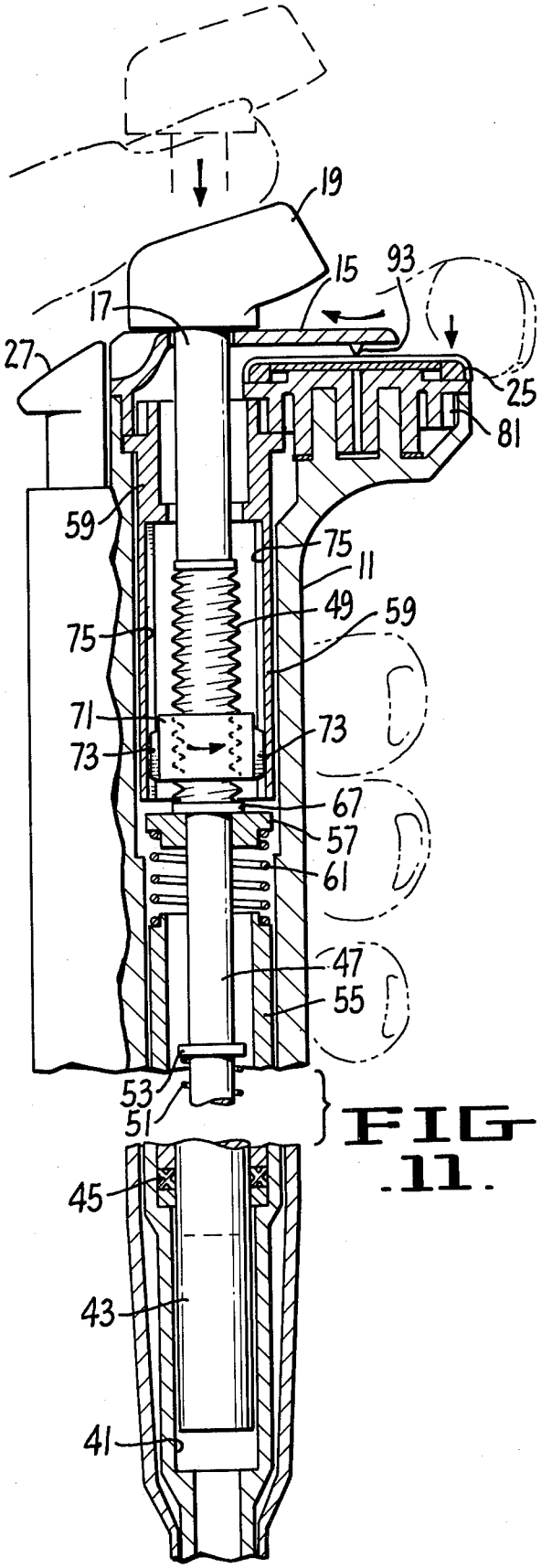
FIG. 11 is a side sectional view of the micropipettor of FIGS. 1-10 illustrating its operation to change the pipette volume setting.

A volume adjustment is accomplished in a manner illustrated in FIG. 11 wherein the plunger is fully depressed into the micropipettor body to drive the instrument into its overshoot position wherein the bottom plunger stop 67 moves the bottom body stop washer 57 downward against the spring 61 and relieves the force from the sleeve 59. The sleeve 59 is then free to be rotated by an operator first depressing and then rotating the volume adjustment knob 23, as shown in FIG. 11. This volume adjustment is accomplished by the index finger of a single operator hand while the plunger is held depressed with the thumb.

Figure 4:
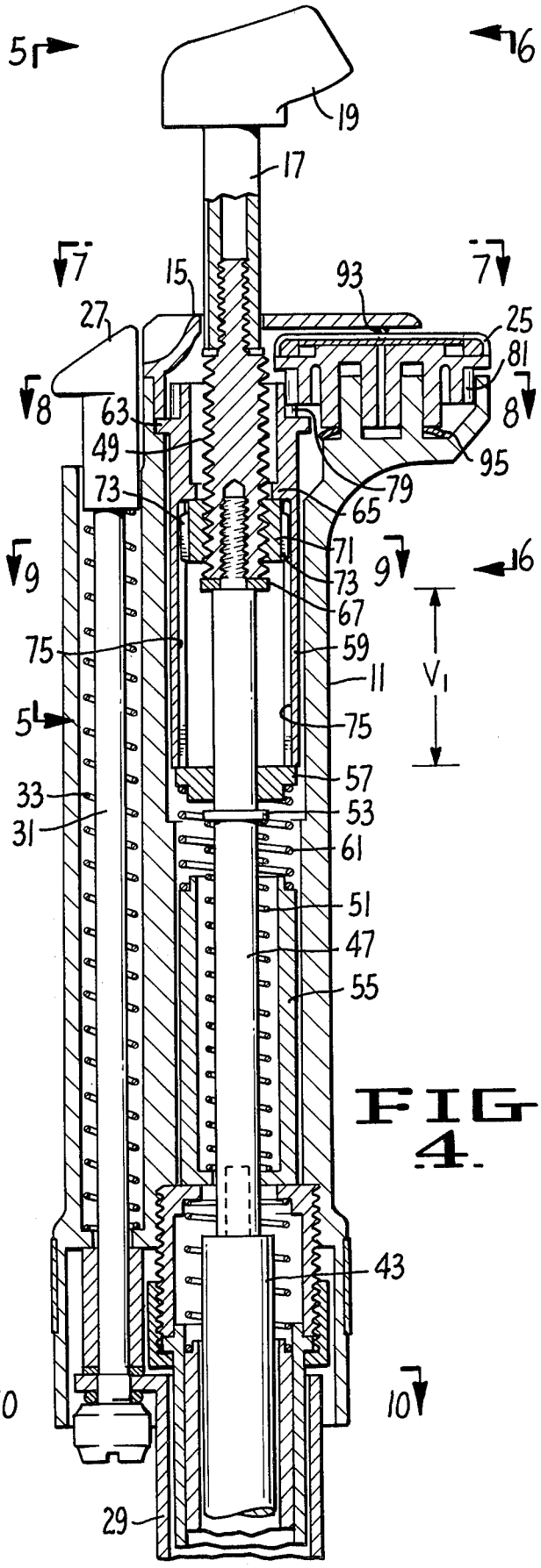
FIG. 4 is an enlarged side cross-sectional view of the upper internal components of the micropipettor of FIGS. 1-3.
Figure 5:
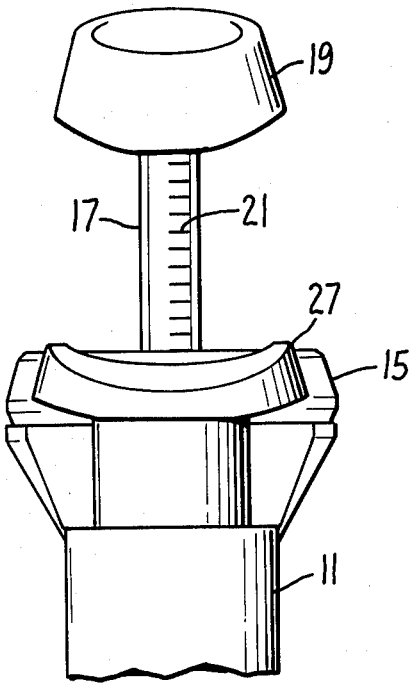
FIG. 5 is an outside view of the upper end of the micropipettor of FIGS. 1-4 taken at section 5—5 of FIG. 4.
Figure 6:
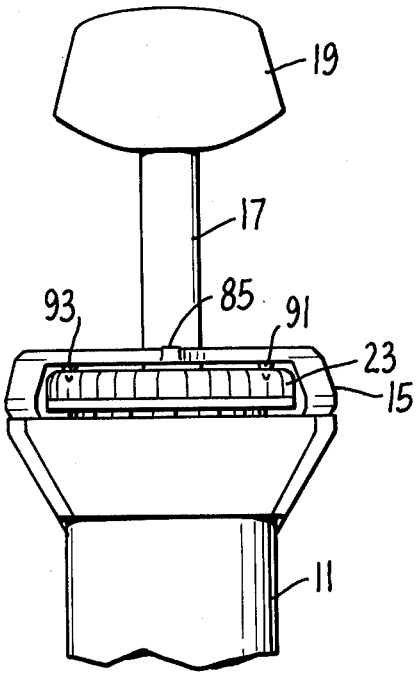
FIG. 6 is an outside view of the upper end of the micropipettor of FIGS. 1-4 taken at section 6—6 of FIG. 4.
Figure 7:
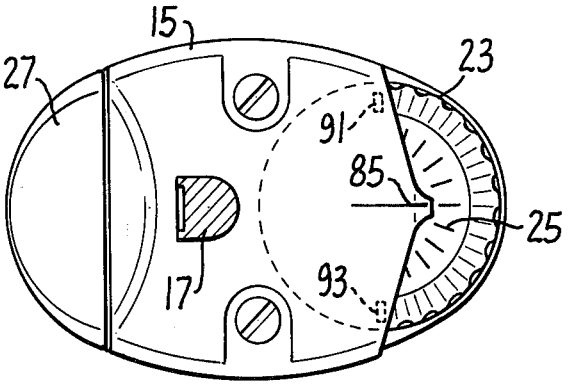
FIGS. 7, 8, 9 and 10 are sectional views taken through the micropipettor of FIGS. 1-4 at sections, respectively, 7—7, 8—8, 9—9 and 10—10 of FIG. 4.
Figure 8:
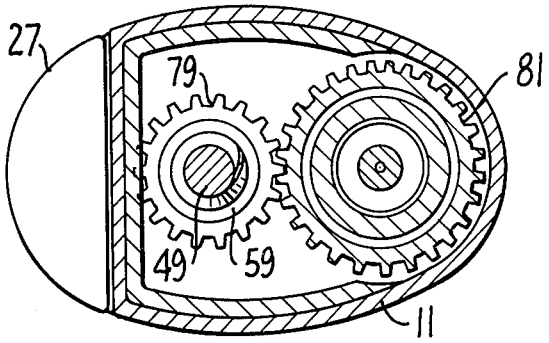
Figure 9:
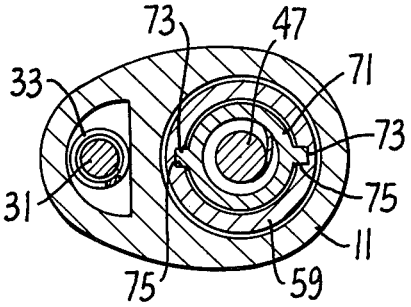
Figure 10:
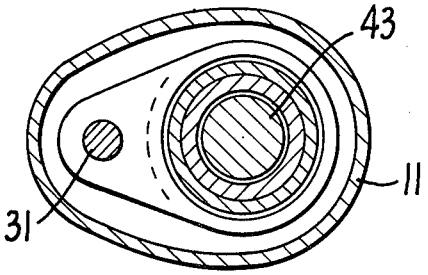
Figure 12:
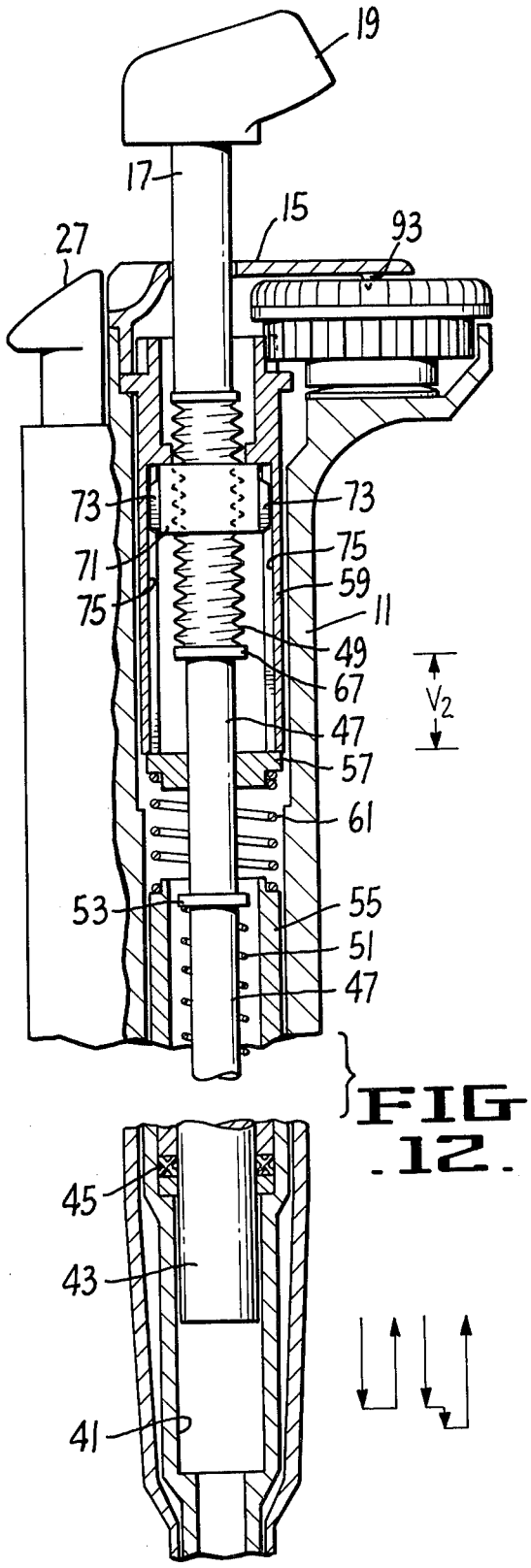
FIG. 12 is a side sectional view of the micropipettor of FIGS. 1-11 that is similar to that of FIG. 4 but showing its port in a different pipette volume setting.

It will be noted from FIG. 4 that the stroke length is denoted by a distance $V_1$ while after a volume adjustment in accordance with movement of various parts in a direction marked in FIG. 11, the stroke length has been shortened to a distance $V_2$ shown in FIG. 12. By moving the position of the nut 71 along the length of the threaded portion 49 of the plunger assembly, the rest position of the plunger assembly is changed, as can be seen by comparing FIGS. 4 and 12.

The linear scale 21 provided on the plunger assembly includes major liquid transfer volume indications that the plunger is moved between, with respect to its indicating surface 37, by a single revolution of the volume adjustment wheel 23. This relationship is accomplished by a particular spacing of the markings on the scale 21, by the pitch of the threads 49 and the mating threads inside the nut 71, and further by the gear ratio between the mating gear 79 and 81. The volume markings on the circular scale 25 of the wheel 21, as read at a fixed indicator 85, thus provides a fine volume adjustment reading. It can thus be seen that by use of only one volume adjustment wheel and circular scale, precise volume indications can be had.

Although the various aspects of the present invention have been described with respect to its preferred embodiment, it will be understood that the invention is entitled to protection within the full scope of the appended claims.

We claim:

1. In a device having a plunger reciprocal within a body through a defined stroke distance set by limiting abuttments for transferring a volume of fluid proportional to the stroke distance, an improved mechanism for adjusting an abuttment on the plunger for continuously varying the volume of liquid transferred, comprising:

a volume adjustment knob located external of said body, a motion transmitting element held within said body surrounding a portion of said plunger and held to be rotatable with respect to the body in response to rotation of said volume adjustment knob, an adjustable stop carried by said plunger within said motion transmitting element and operably connected therewith in a manner that rotation of said element causes said stop to move axially along said plunger, means within said body for normally restraining movement of said element, and means responsive to said plunger being placed at a particular position for releasing said element restraining means, whereby movement of said volume adjustment knob is automatically locked unless the operator deliverately places the plunger in a particular position, thus avoiding inadvertent volume setting changes.

2. The improved device according to claim 1 wherein said volume adjustment knob is provided with means for normally holding said knob against rotation, and means responsive to depressing said knob for releasing said rotation holding means, whereby a second automatic lock is provided to prevent accidental volume adjustment.

3. A hand-held micropipettor, comprising:

an elongated body, a plunger assembly held within said body in a manner to be movable back and forth along its length and extending out of an upper end of said body in order to be hand manipulatable, said plunger being resiliently held in a rest position toward said upper end of said body by a first spring, a cylindrical sleeve positioned within said body in a manner to be rotatable with respect thereto but held against axial movement, said sleeve surrounding said plunger, a washer normally urged against a lower end of said sleeve by a second spring having a strength much greater than said first spring, an external volume adjustment knob held to rotate about an axis substantially parallel to but displaced from said plunger and located along side thereof at said one body end, means interconnecting said cylindrical sleeve and said knob for causing said sleeve to rotate in response to said knob being rotated by an operator, said washer and ledge inside of said sleeve defining the stroke length of said plunger in conjunction with cooperating abutments along the length of said plunger, an upper of said plunger abutments constituting a member held by the plunger in threaded engagement therewith in a manner that rotation thereof causes the member to move back and forth along the plunger thereby adjusting the stroke length to a desired value, means operably connecting said sleeve and said adjustable stop member for rotating the adjustable stop member in response to the cylindrical sleeve rotating but at the same time permitting axial movement of the plunger and stop member with respect to the sleeve, and a lower of said plunger abutments being fixed to said plunger, whereby movement of said plunger so that its lower fixed stop moves the stop washer against said second spring relieves the forces against said cylindrical sleeve for easy rotation thereof while assuring the inadvertent changes in volume adjustment are not made during normal pipetting operations.

4. The micropipettor according to claim 3 wherein said second spring additionally functions to provide a piston overshoot upon discharge of liquid from the micropipettor.

5. The micropipettor according to claim 3 wherein a spring element is provided in association with said volume adjustment knob in a manner to normally urge said knob upwards, said knob being provided with undulations around its edge on its top surface, and further wherein a detent is fixed to said body above the volume adjustment knob in a position to normally engage a depression of the knob undulations to hold it against rotation, whereby the knob is rotated by an operator first depressing the knob against the spring to free it of its engagement with the detent.

* * * * *